US008400750B2

(12) United States Patent
Tsai et al.

(10) Patent No.: US 8,400,750 B2
(45) Date of Patent: Mar. 19, 2013

(54) PARTICLE CHARGER WITH SHEATH AIR FLOW FOR ENHANCING CHARGING EFFICIENCY

(75) Inventors: Chuen-Jinn Tsai, Hsinchu County (TW); Lin Guan-Yu, Taipei County (TW); Chen Hui-Lin, Keelung (TW)

(73) Assignee: National Chiao Tung University, Hsinchu (TW)

( * ) Notice: Subject to any disclaimer, the term of this patent is extended or adjusted under 35 U.S.C. 154(b) by 488 days.

(21) Appl. No.: 12/654,667

(22) Filed: Dec. 29, 2009

(65) Prior Publication Data

US 2011/0090611 A1 Apr. 21, 2011

(30) Foreign Application Priority Data

Oct. 15, 2009 (TW) ..... 98134998 A

(51) Int. Cl.
*H01T 23/00* (2006.01)

(52) U.S. Cl. ..... 361/230; 435/173.1

(58) Field of Classification Search ..... 361/230; 435/173.1

See application file for complete search history.

(56) References Cited

U.S. PATENT DOCUMENTS 5,247,842 A * 9/1993 Kaufman et al. ..... 73/865.5
5,973,904 A 10/1999 Pui et al.
6,093,557 A * 7/2000 Pui et al. ..... 435/173.1

OTHER PUBLICATIONS

Chaolong Qi, Da-Ren Chen, David Y.H. Pui, Experimental Study of a New Corona-based Unipolar Aerosol Charger, Aerosol Science 38 (2007) 775-792.
F.E. Kruis and H. Fissan, Nanoparticle Charging in a Twin Hewitt Charger, Journal of Nanoparticle Research 3: 39-50, 2001.
A. Hernandez-Sierra, F.J. Alguacil, M. Alonso, Unipolar Charging of Nanometer Aerosol Particles in a Corona Ionizer, Aerosol Science 34 (2003) 733-745.
Chaolong Qi, Da-Ren Chen, Paul Greenberg, Performance Study of a Unipolar Aerosol Mini-Charger for a Personal Nanoparticle Sizer, Aerosol Science 39 (2008) 450-459.
M. Alonso, M.I. Martin, F.J. Alguacil, The Measurement of Charging Efficiencies and Losses of Aerosol Nanoparticles in a Corona Charger, Journal of Electrostatics 64 (2006). . . .

* cited by examiner

*Primary Examiner* — Rexford Barnie
*Assistant Examiner* — Tien Mai
(74) *Attorney, Agent, or Firm* — Bacon & Thomas, PLLC

(57) ABSTRACT

A particle charger with sheath air flow for enhancing charging efficiency includes a housing and a discharge wire. The housing has a charging chamber for accommodating the discharge wire, a particle inlet, a sheath air inlet, an outlet and an accelerating channel. A clean sheath air is guided through the sheath air inlet into the charging chamber to surround charged particles, reducing deposition of charged particles on the inside wall of the housing. A relatively small annular gap of accelerating channel accelerates the charged particles to exit the particle charger, and therefore minimized the particle electrostatic loss due to depositing on the inner surface of the housing. Additionally, uncharged particles approach the discharge wire axially, and charged particles move away radially. It is helpful for the charged particles to diffuse rapidly and uniformly, thereby enhancing the charging efficiency.

7 Claims, 3 Drawing Sheets

PARTICLE CHARGER WITH SHEATH AIR FLOW FOR ENHANCING CHARGING EFFICIENCY

BACKGROUND OF THE INVENTION

1. Field of the Invention

The present invention relates to air pollution control technology or measuring technology, and more particularly to a particle charger with sheath air flow for enhancing charging efficiency.

2. Description of the Related Art

Particle charging technology has been widely applied to air pollution control and particle concentration measurement. Particle charging efficiency directly affects the performance of the related air pollution control equipment and the sensitivity and accuracy of the particle concentration measuring instrument. Therefore it is important to improve the charging efficiency of a particle charging equipment.

U.S. Pat. No. 5,973,904 discloses a particle charging apparatus, which includes a housing having a longitudinal axis extending between an inlet and an outlet of the housing with a stream of aerosol particles flowing parallel to the longitudinal axis. An electric field is created within the housing for directing a stream of unipolar ions toward the outlet for charging the stream of aerosol particles. Additionally, a clean sheath air is created between the stream of aerosol particles and the housing to reduce charged particle loss within the housing. But the sheath air velocity is not properly controlled and is not high enough to prevent loss of charged particles on the wall.

In addition, the aforesaid particle charging apparatus needs radioactive isotope to achieve discharging, a metal screen to create a clean sheath and a complicated design to create an axial electric field. These technical features complicate the structure of the particle charging apparatus, resulting in the increase of cost and causing the apparatus unable to be miniaturized for use in a portable particle measuring instrument.

SUMMARY OF THE INVENTION

The main object of the present invention is to provide a particle charger with high velocity sheath air flow near the inner wall of the charger for enhancing charging efficiency, which has a simple structure and can be optimized for smaller size.

To achieve this and other objectives of the present invention, a particle charger with high speed sheath air flow for enhancing charging efficiency comprises a housing and a discharge wire. The housing is made of electrically conductive material, comprising a charging chamber, a particle inlet, an outlet and a first accelerating channel. The particle inlet is disposed in communication with the charging chamber. The first accelerating channel with a small annular gap is connected between the charging chamber and the outlet. The discharge wire is arranged in the charging chamber of the housing. The charging chamber and the particle inlet of the housing both have a circular cross section. The charging chamber, the particle inlet and the discharge wire extend along the same longitudinal axis. The particle charger further comprises an insulative cover, a first flow guide sleeve, a second flow guide sleeve, an insulative cover, a conductive rod and an electrode holder. The first flow guide sleeve is mounted inside the housing. The gap of the first accelerating channel is defined between the first flow guide sleeve and the inside wall of the housing. Further, the first flow guide sleeve comprises an outside annular groove extending around the periphery thereof at a location corresponding to the outlet of the housing. The housing further comprises a sheath air inlet. The second accelerating channel is connected between said charging chamber and said sheath air inlet, and included a gap defined between said second flow guide sleeve and an inside wall of said housing. The second flow guide sleeve comprises an outside annular groove extending around the periphery thereof at a location corresponding the sheath air inlet, and an axial hole disposed in communication with the charging chamber and the particle inlet of the housing. The insulative cover is attached to the housing, having a center hole for the passing of the conducting rod. The electrode holder is mounted inside the housing, comprising an insulative holder body and a metal conductor. The insulative holder body is connected to the bottom end of the conducting rod. The metal conductor is mounted in the insulative holder body and electrically connected with the conducting rod and the discharge wire. Further, the first flow guide sleeve has a center hole for the passing of the conducting rod.

DETAILED DESCRIPTION OF THE INVENTION

Figure 1:
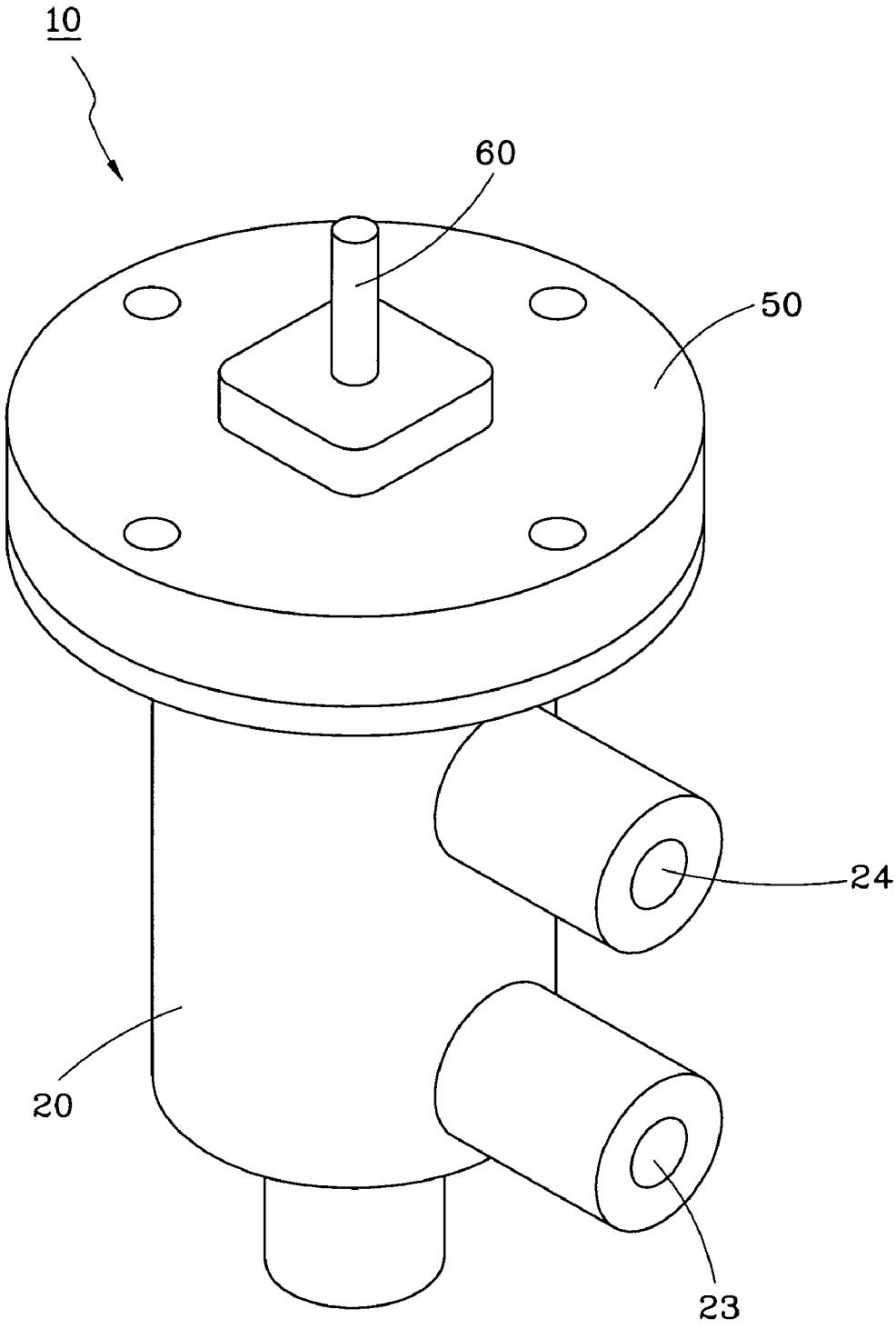
FIG. 1 is the block diagram of the particle charger with sheath air flow for enhancing charging efficiency in accordance with the present invention.
Figure 2:
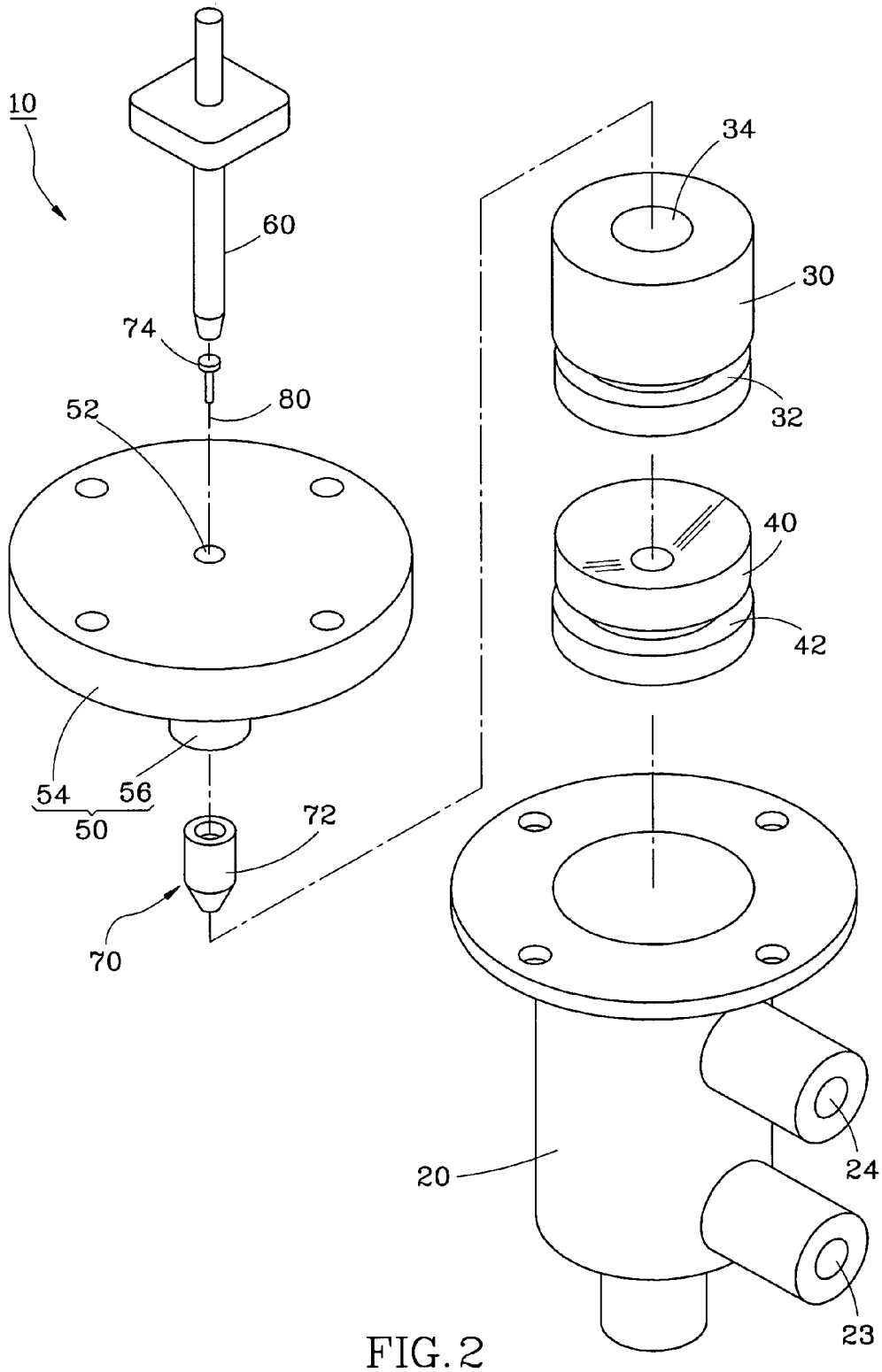
FIG. 2 is an exploded view of the particle charger with sheath air flow for enhancing charging efficiency in accordance with the present invention.
Figure 3:
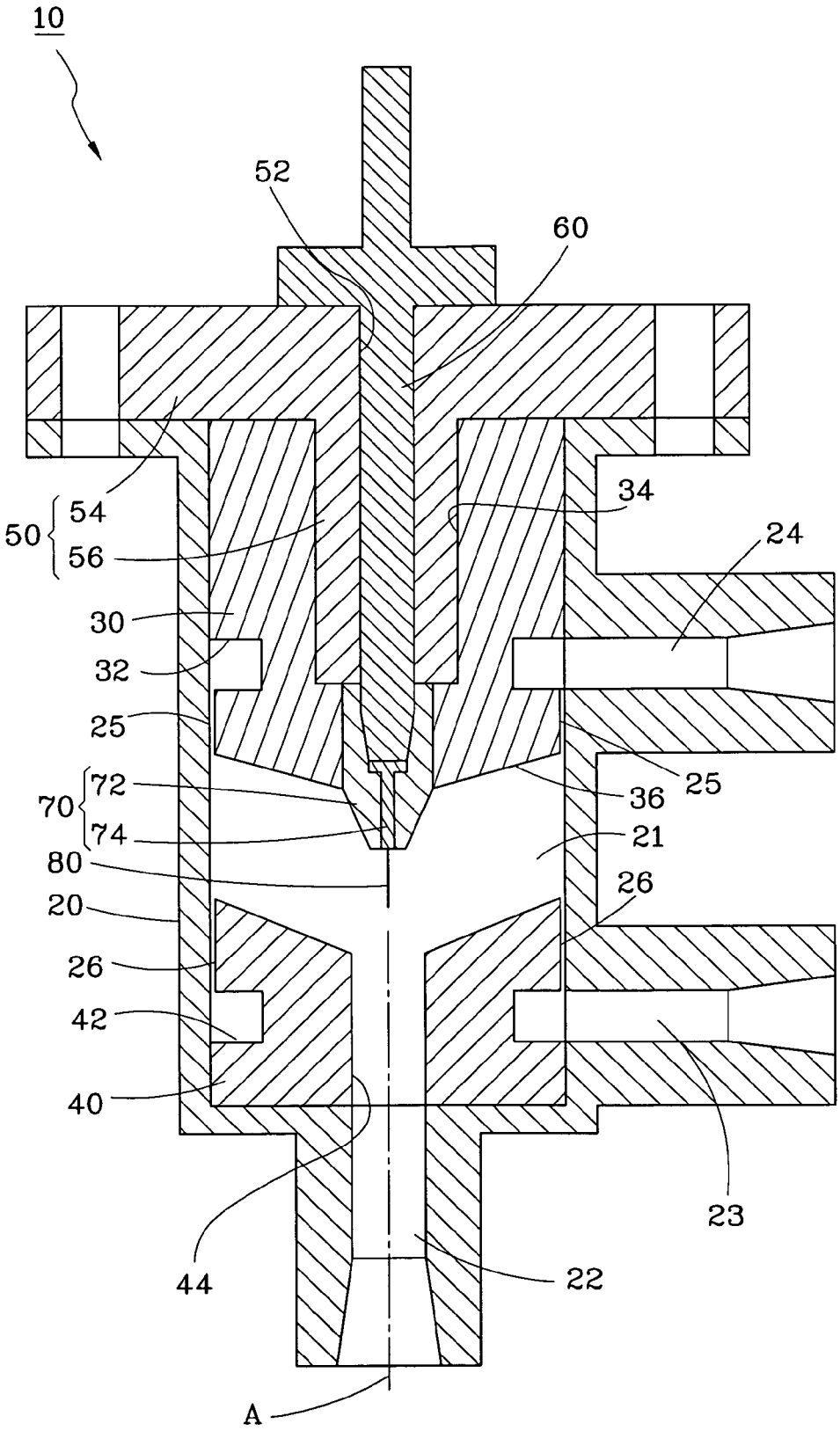
FIG. 3 is a sectional view of the particle charger with sheath air flow for enhancing charging efficiency in accordance with the present invention.

Referring to FIGS. 1~3, a particle charger 10 in accordance with the present invention is shown comprising a housing 20, a first flow guide sleeve 30, a second flow guide sleeve 40, an insulative cover 50, a conducting rod 60, an electrode holder 70 and a discharge wire 80.

The cylindrical housing 20 is made from an electrically conducting material, defining a longitudinal axis A. The inside of the housing 20 has a charging chamber 21, a particle inlet 22, a sheath air inlet 23, an outlet 24, a first accelerating channel 25 and a second accelerating channel 26. The particle inlet 22 is in communication with the charging chamber 21. The first accelerating channel 25 is connected between the charging chamber 21 and the outlet 24. The first accelerating channel 25 has a small annular gap 25 formed between the first flow guide sleeve 30 and an inside wall of the cylindrical housing 20. The second accelerating channel 26 is connected between the charging chamber 21 and the sheath air inlet 23. The second accelerating channel 26 has small annular gap 26 formed between the second flow guide sleeve 40 and an inside wall of the cylindrical housing 20.

The first flow guide sleeve 30 and the second flow guide sleeve 40 are cylindrical and mounted inside the housing 20. The first flow guide sleeve 30 and the second flow guide sleeve 40 each have an annular groove 32 or 42 extending around the periphery. The two annular grooves 32 and 42 are disposed corresponding to the sheath air inlet 23 and the outlet 24 respectively. The first flow guide sleeve 30 has a center hole 34, and a bottom conical surface 36. The second flow guide sleeve 40 has an axial hole 44 in communication between the charging chamber 21 and the particle inlet 22.

The insulative cover 50 is a single-piece member prepared from an electrically insulative material, having a cylindrical large diameter portion 54 and a cylindrical small diameter portion 56 axially connected together. The cylindrical large diameter portion 54 is disposed at the top side of the cylindrical small diameter portion 56. The cylindrical small diameter portion 56 is inserted into the center hole 34 of the first flow guide sleeve 30. Further, the insulative cover 50 has a center hole 52 and an inner thread (not shown) extending around the inside wall of the center hole 52.

The conducting rod 60 is a metal member mounted in the center hole 52 of the insulative cover 50. The conducting rod 60 has an outer thread (not shown) meshed with the inner thread (not shown) in the center hole 52 of the insulative cover 50.

The electrode holder 70 is mounted inside the housing 20, comprising an electrically insulative holder body 72 and a metal conductor 74. The electrically insulative holder body 72 is threaded onto the bottom end of the conducting rod 60. The metal conductor 74 is inserted into the inside of the electrically insulative holder body 72 and electrically connected to the conducting rod 60. The cylindrical small diameter portion 56 of the insulative cover 50, the conducting rod 60 and the electrode holder 70 are inserted into the center hole 34 of the first flow guide sleeve 30.

The discharge wire 80 is arranged inside the charging chamber 21 of the housing 20 and electrically connected to the conducting rod 60 through the metal conductor 74 of the electrode holder 70. The discharge wire 80 extends along the longitudinal axis A of the housing 20.

The conducting rod 60 is connected with a high-voltage DC power source (not shown), whereas the housing 20 is grounded, thus electric field can be formed between the discharge wire 80 and the housing 20. When a stream of particles is guided through the particle inlet 22 into the charging chamber 21, they are charged by the discharge wire 80 due to diffusion and field charging mechanisms. Thereafter, charged particles go through the first accelerating channel 25 and the outlet 24 to the outside of the particle charger 10 for further application. A high speed clean sheath air is guided through the sheath air inlet 23 and the second accelerating channel 26 into the charging chamber 21 to prevent deposition of charged particles on the inside wall of the housing 20.

In addition, the first accelerating channel 25 has a relatively small annular gap which helps accelerating the flow and guiding charged particles to exit the particle charger 10 rapidly, and therefore the particle electrostatic loss due to depositing on the inner surface of the housing 20 is minimized. Further, the charging chamber 21, the particle inlet 22 and the discharge wire 80 extend along the same longitudinal axis A so that particles that approach the discharge wire 80 axially are charged in the charging chamber 21. The smooth and unobstructed route is helpful for the charged particles to diffuse rapidly and uniformly, thereby enhancing the charging efficiency.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A particle charger, comprising:

a housing made from an electrically conductive material, said housing comprising a charging chamber, a particle inlet, a sheath air inlet, an outlet and a first accelerating channel, said particle inlet being disposed in communication with said charging chamber for introducing a stream of particles into said charging chamber, said sheath air inlet being disposed in communication with said charging chamber for introducing a sheath air into said charging chamber, said first accelerating channel being connected between said charging chamber and said outlet and including a gap for transmitting said stream of particles and said sheath air from said charging chamber to said outlet;

a discharge wire arranged in said charging chamber of said housing; and a first flow guide sleeve mounted inside said housing; said gap of said first accelerating channel being defined between said first flow guide sleeve and an inside wall of said housing, wherein said first flow guide sleeve comprises an outside annular groove extending around the periphery thereof at a location corresponding to said outlet of said housing.

2. The particle charger as claimed in claim 1, further comprising a second flow guide sleeve mounted inside said housing, said housing further comprising a second accelerating channel being connected between said charging chamber and said sheath air inlet, said second accelerating channel including a gap defined between said second flow guide sleeve and an inside wall of said housing.

3. The particle charger as claimed in claim 2, wherein said second flow guide sleeve comprises an outside annular groove extending around the periphery thereof at a location corresponding said sheath air inlet.

4. The particle charger as claimed in claim 2, wherein said second flow guide sleeve comprises an axle hole disposed in communication with said charging chamber and said particle inlet of said housing.

5. The particle charger as claimed in claim 1, wherein said charging chamber and said particle inlet of said housing each have a circular cross section; said charging chamber, said particle inlet and said discharge wire extend along one same longitudinal axis.

6. A particle charger comprising:

a housing made from an electrically conductive material, said housing comprising a charging chamber, a particle inlet, a sheath air inlet, an outlet and a first accelerating channel, said particle inlet being disposed in communication with said charging chamber for introducing a stream of particles into said charging chamber, said sheath air inlet being disposed in communication with said charging chamber for introducing a sheath air into said charging chamber, said first accelerating channel being connected between said charging chamber and said outlet and including a gap for transmitting said stream of particles and said sheath air from said charging chamber to said outlet;

a discharge wire arranged in said charging chamber of said housing; and a first flow guide sleeve mounted inside said housing; said gap of said first accelerating channel being defined between said first flow guide sleeve and an inside wall of said housing, further comprises an insulative cover, a conducting rod and an electrode holder, said insulative cover being attached to said housing and having a center hole for the passing of said conducting rod, said electrode holder being mounted inside said housing and comprising an insulative holder body and a metal conductor, said insulative holder body being connected to a bottom end of said conducting rod, said metal conductor being mounted in said insulative holder body and electrically connected with said conducting rod and said discharge wire.

7. The particle charger as claimed in claim 6, further comprising a first flow guide sleeve mounted inside said housing, said first flow guide sleeve having a center hole for the passing of said conducting rod.

* * * * *